US008302668B1

(12) United States Patent
Bullied et al.

(10) Patent No.: US 8,302,668 B1
(45) Date of Patent: Nov. 6, 2012

(54) HYBRID CORE ASSEMBLY FOR A CASTING PROCESS

(75) Inventors: Steven J. Bullied, Pomfret Center, CT (US); Carl R. Verner, Windsor, CT (US); John Joseph Marcin, Marlborough, CT (US); Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/155,672

(22) Filed: Jun. 8, 2011

(51) Int. Cl.
*B22C 9/10* (2006.01)

(52) U.S. Cl. ..... 164/516; 164/28; 164/369

(58) Field of Classification Search ..... 164/28, 164/516, 361, 369
See application file for complete search history.

(56) References Cited

U.S. PATENT DOCUMENTS

| | | | | |
|---|---|---|---|---|
| 6,637,500 | B2 | 10/2003 | Shah et al. | |
| 7,108,045 | B2 | 9/2006 | Wiedemer et al. | |
| 7,144,220 | B2 | 12/2006 | Marcin, Jr. | |
| 7,270,170 | B2 | 9/2007 | Beals et al. | |
| 7,779,892 | B2 | 8/2010 | Luczak et al. | |
| 7,866,370 | B2 | 1/2011 | Cunha | |
| 2004/0020629 | A1 * | 2/2004 | Shah et al. | 164/369 |
| 2005/0274478 | A1 * | 12/2005 | Verner et al. | 164/45 |
| 2007/0068649 | A1 | 3/2007 | Verner et al. | |
| 2007/0221359 | A1 | 9/2007 | Reilly | |

* cited by examiner

*Primary Examiner* — Kuang Lin
(74) *Attorney, Agent, or Firm* — Carlson, Gaskey & Olds PC

(57) ABSTRACT

A hybrid core assembly for a casting process includes a ceramic core portion, a first refractory metal core portion and a first plate positioned between the ceramic core portion and the first refractory metal core portion. The ceramic core portion includes a first trough. A portion of the refractory metal core portion is received in the first trough.

23 Claims, 10 Drawing Sheets

HYBRID CORE ASSEMBLY FOR A CASTING PROCESS

This invention was made with government support under Contract No. N00019-02-C-3003 awarded by the United States Navy. The Government has certain rights in this invention.

BACKGROUND

This disclosure relates to a core assembly, and more particularly to a hybrid core assembly used in a casting process to manufacture a part.

Gas turbine engines are widely used in aircraft propulsion, electric power generation, ship propulsion and pumps. Many gas turbine engine components are made in a casting process. One example casting process is investment casting. Investment casting can be used to form metallic components having complex geometries, such as gas turbine engine components requiring internal cooling passageways. Blades and vanes are examples of such components.

Investment casting involves preparing a mold having one or more mold cavities that include a shape generally corresponding to the part to be cast. A wax pattern of the component is formed by molding wax over a core assembly. In a shelling process, a shell is formed around one or more of the wax patterns. The wax is melted and removed. The shell is fired to harden the shells such that the mold is formed comprising the shell having one or more part defining compartments that include the core assembly. Molten material is then introduced to the mold to cast the component. Upon cooling and solidifying of the alloy, the shell and core assembly are removed.

SUMMARY

A hybrid core assembly for a casting process includes a ceramic core portion, a first refractory metal core portion and a first plate positioned between the ceramic core portion and the first refractory metal core portion. The ceramic core portion includes a first trough. A portion of the refractory metal core portion is received in the first trough.

In another exemplary embodiment, a method of assembling a hybrid core assembly for a casting process includes inserting a portion of a refractory metal core portion through an opening of a plate and positioning the plate relative to a trough of a ceramic core portion.

The various features and advantages of this disclosure will become apparent to those skilled in the art from the following detailed description. The drawings that accompany the detailed description can be briefly described as follows.

DETAILED DESCRIPTION

Figure 1:
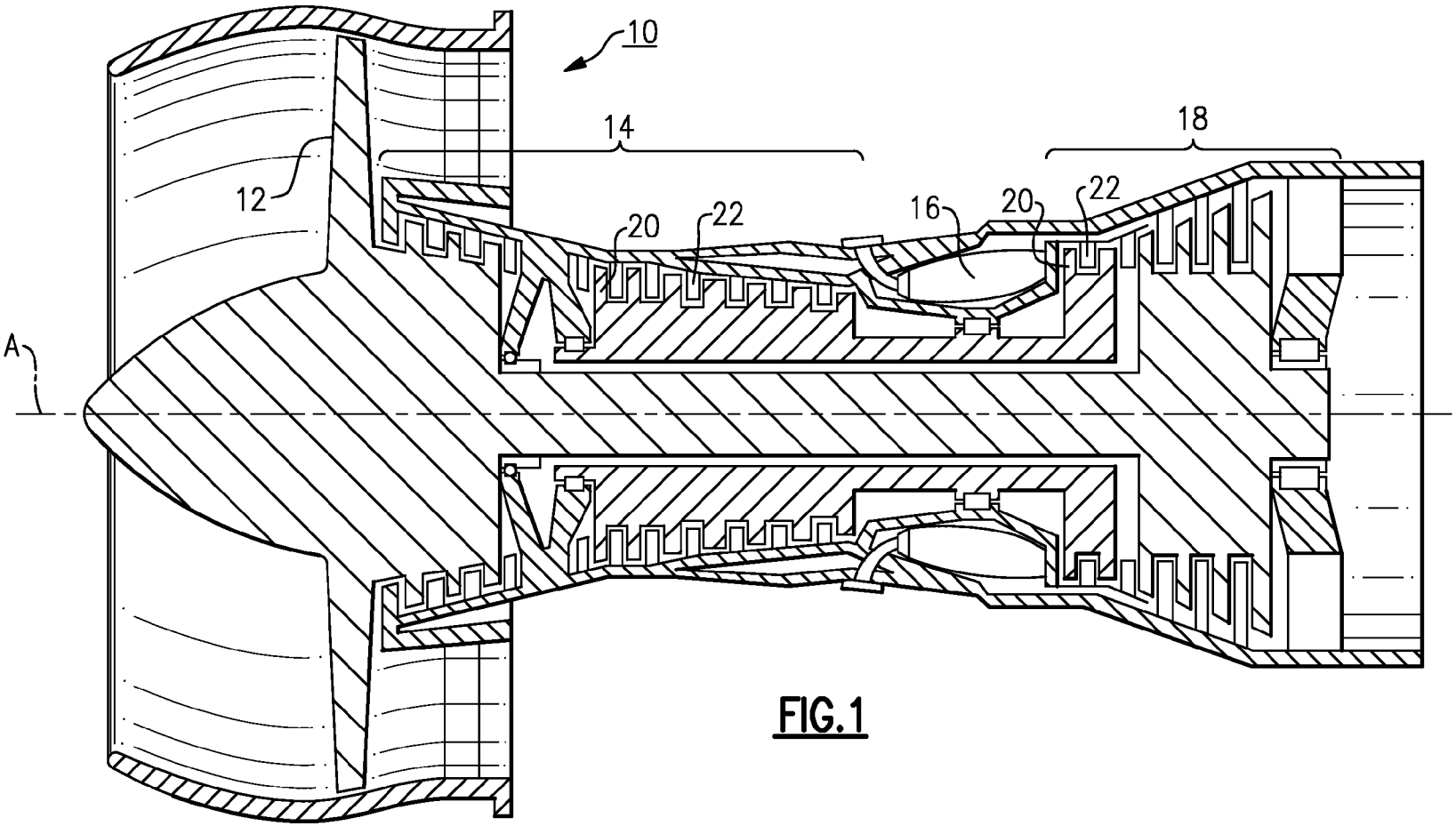
FIG. 1 shows a schematic view of a gas turbine engine.

FIG. 1 illustrates an example gas turbine engine 10 that is circumferentially disposed about an engine centerline axis A. The gas turbine engine 10 includes (in serial flow communication) a fan section 12, a compressor section 14, a combustor section 16 and a turbine section 18. During operation, air is compressed in the compressor section 14 and is mixed with fuel and burned in the combustor section 16. The combustion gases are discharged through the turbine section 18, which extracts energy from the combustion gases for powering the compressor section 14 and the fan section 12, among other loads.

The gas turbine engine 10 includes a plurality of parts that may be manufactured in a casting process, such as an investment casting process or other suitable casting process. For example, both the compressor section 14 and the turbine section 18 include alternating rows of rotating blades 20 and stationary vanes 22 that may be manufactured in a casting process. The blades 20 and the vanes 22, especially those in the turbine section 18, are subjected to repetitive thermal cycling under widely ranging temperatures and pressures. Therefore, these parts may require internal passages for cooling the part. Example hybrid core assemblies for casting such a part are discussed below.

This view is highly schematic and is included to provide a basic understanding of the gas turbine engine 10 and not to limit the disclosure. This disclosure extends to all types of gas turbine engines and for all types of applications.

Figure 2:
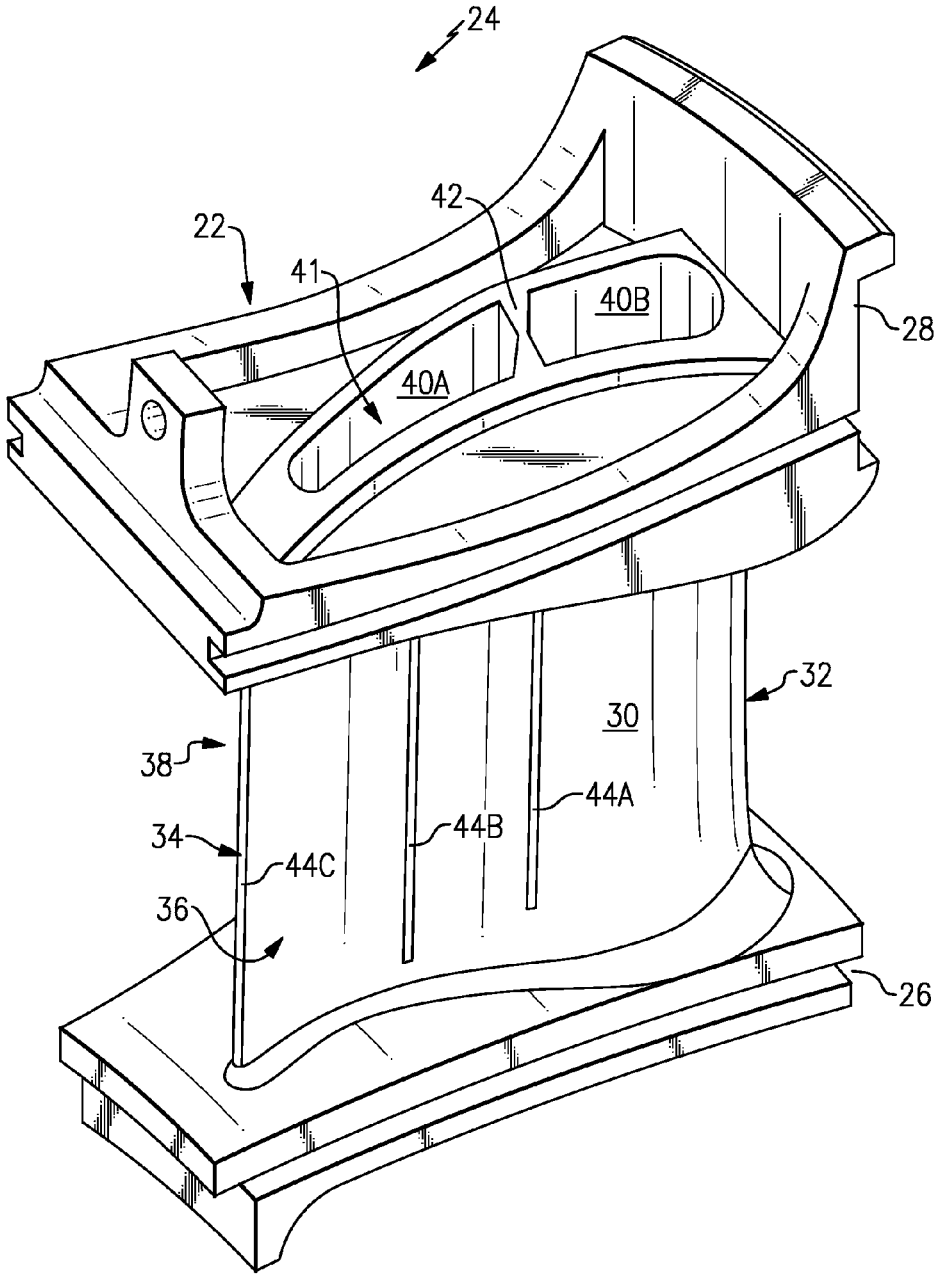
FIG. 2 illustrates a part that can be manufactured in a casting process.

FIG. 2 illustrates a part 24 that may be manufactured using a casting process, such as an investment casting process. In this example, the part 24 is a vane 22 of the turbine section 18. Although the part 24 is illustrated in this example as a vane 22 of the turbine section 18, the various features and advantages of this disclosure are applicable to any cast part of a gas turbine engine, or any other part.

The part 24 includes an inner diameter platform 26, an outer diameter platform 28, and an airfoil 30 that extends between the inner diameter platform 26 and the outer diameter platform 28. The airfoil 30 includes a leading edge 32 and a trailing edge 34 and further includes a pressure side 36 and a suction side 38.

The part 24 can further include internal cooling passages 40A and 40B that are separated by a rib 42. The internal cooling passages 40A, 40B include refractory metal core formed cavities that exit the airfoil 30 at slots 44A, 44B and 44C. The internal cooling passages 40A, 40B and their respective refractory metal core formed cavities define an internal circuitry 41 within the part 24 for cooling the part 24. The internal cooling passages 40A, 40B and the internal circuitry 41 of the part 24 are depicted for illustrative purposes only. A person of ordinary skill in the art would understand that various alternative cooling passage and internal circuitry configurations could be cast in the part 24.

In operation, cooling airflow, such as bleed airflow from the compressor section 14, is communicated through the internal cooling passages 40A, 40B and out the slots 44A, 44B and 44C to cool the airfoil 30 from the hot gases that are communicated from the leading edge 32 of the airfoil 30 to the trailing edge 34 along the pressure side 36 and suction side 38 of the airfoil 30. The cooling airflow is circulated through the internal circuitry 41 to cool the part 24.

Figure 3:
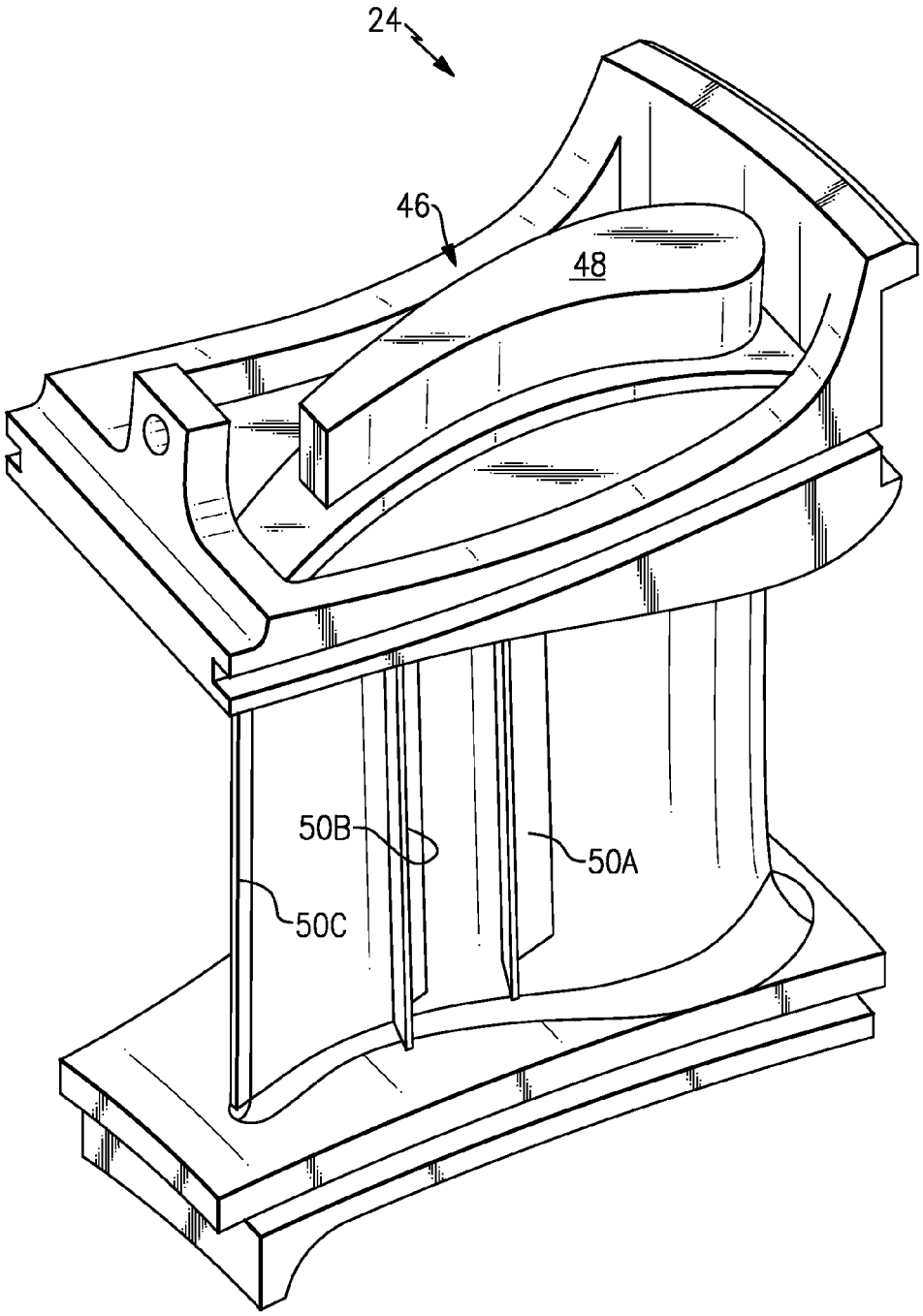
FIG. 3 illustrates the part of FIG. 2 prior to removal of a hybrid core assembly.

FIG. 3 illustrates the part 24 of FIG. 2 prior to removal of a hybrid core assembly 46 that is used during the casting process to define the internal cooling passages 40A, 40B and the internal circuitry 41 of the part 24. In this disclosure, the term "hybrid core assembly" is intended to describe an assembled core assembly for use in a casting process that includes at least a refractory metal core (RMC) portion and a ceramic core portion. A refractory metal core is a core that is made out of molybdenum or other like material. The ceramic core portion can include any suitable ceramic.

In this example, the hybrid core assembly 46 includes multiple RMC portions 50A (i.e, a first RMC portion), 50B (i.e., a second RMC portion) and 50C (i.e, a third RMC portion) attached to a ceramic core portion 48. The RMC portions 50A and 50B are skin cores and the RMC portion 50C is a trailing edge core. Although three RMC portions 50A, 50B and 50C are illustrated in this example, the actual number of RMC portions is dependent on the cooling requirements of the part 24. For example, the hybrid core assembly 46 could include only a first RMC portion 50A attached to the ceramic core portion 48. Once removed from the part 24, such as in a leeching operation, the ceramic core portion 48 forms the internal cooling passages 40A, 40B and the rib 42 (See FIG. 2). Removal of the RMC portions 50A, 50B and 50C in a post-cast operation forms the slots 44A, 44B and 44C that jut out from the airfoil 30 and the various cavities that define the internal circuitry 41 of the part 24 (See FIG. 2).

Figure 4:
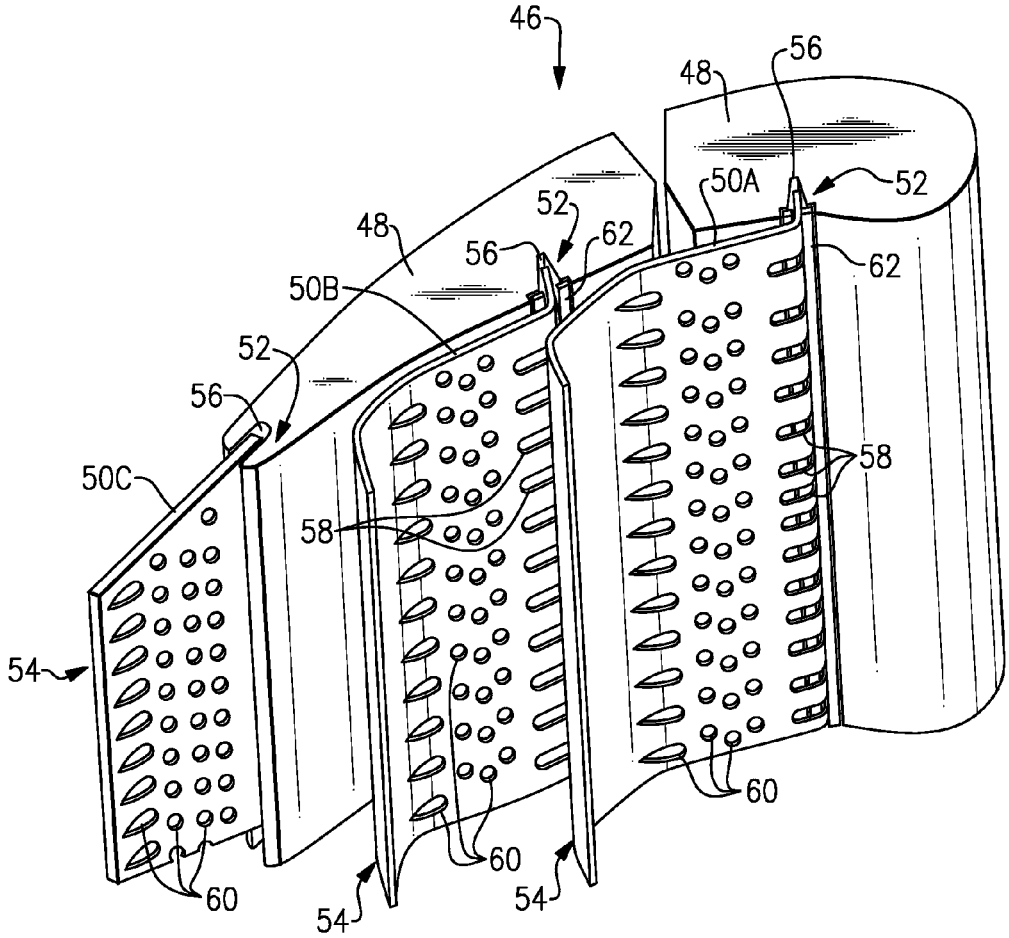
FIG. 4 illustrates an example hybrid core assembly for a casting process.

FIG. 4 illustrates an example hybrid core assembly 46. The assembled hybrid core assembly 46 includes the ceramic core portion 48 and several RMC core portions 50A, 50B and 50C. Each RMC portion 50A, 50B and 50C includes entrance ends 52 and exit ends 54. The entrance ends 52 interface with troughs 56 (here, a first trough, second trough and third trough) formed in the ceramic core portion 48. The troughs 56 are receptacles for receiving portions of the RMC portions 50A, 50B and 50C. The length, depth and overall geometry and configuration of the troughs 56 can vary and can be cast or machined into the ceramic core portion 48. The exit ends 54 of the RMC portions 50A, 50B and 50C jut out from the airfoil 30 (see FIG. 3).

The entrance ends 52 of the RMC portions 50A, 50B and 50C can include a plurality of cut-in features 58 that dictate the amount of airflow that is fed into the entrance ends 52 for cooling the part 24. The example RMC portions 50A, 50B and 50C also include a plurality of features 60 that further define the internal circuitry 41 ultimately formed in the cast part 24. The RMC portions 50A, 50B and 50C can also include a coating, such as an aluminide coating, that protects against adverse chemical reactions that can occur during a casting process.

The hybrid core assembly 46 further includes a plate 62 positioned between each RMC portion 50A and 50B and the ceramic core portion 48. In this example, the RMC portion 50C does not require a plate 62 because it is a trailing edge RMC, although a plate could be used. The plates 62 are positioned to generally cover the troughs 56 and for attaching the refractory metal core portions 50A, 50B to the ceramic core portion 48. The plates 62 can be made of a refractory metal, such as molybdenum or other suitable refractory metal. In one example, the plates 62 include the same material used to form the RMC portions 50A, 50B and 50C. The plates 62 can also be made from a ceramic or metallic material.

Figure 5A:
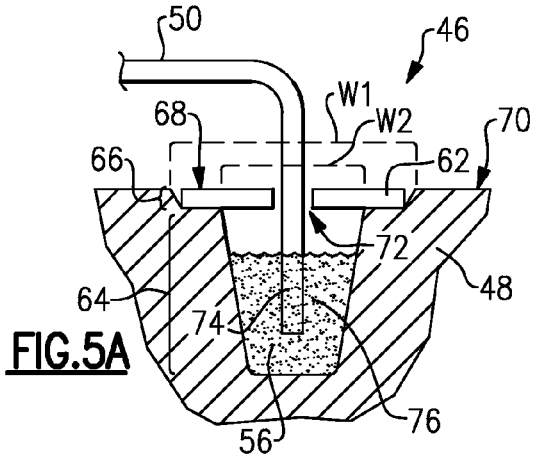
FIGS. 5A, 5B and 5C illustrate various aspects of the hybrid core assembly of FIG. 4.
Figure 5B:
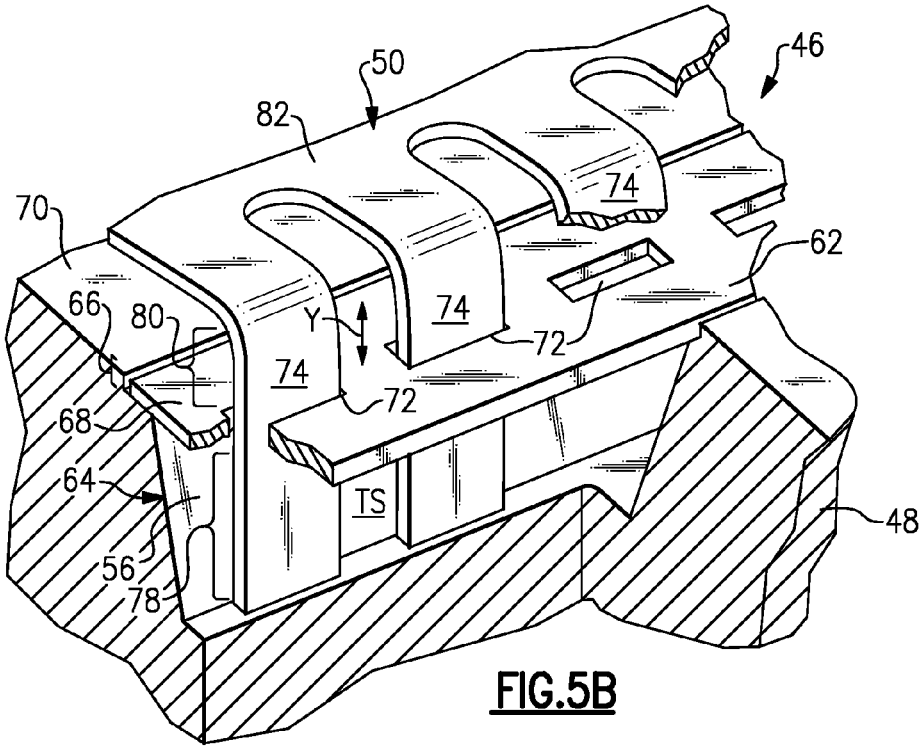
Figure 5C:
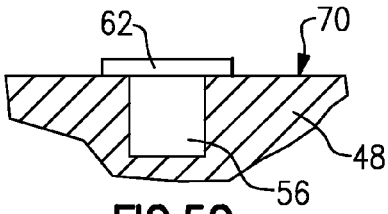

FIGS. 5A, 5B and 5C illustrate additional aspects of the example hybrid core assembly 46. The troughs 56 of the ceramic core portion 48 can include a stepped geometry, such as depicted in FIGS. 5A and 5B. That is, each trough 56 can include a lower trough portion 64 and a stepped trough portion 66. The width W1 of the stepped trough portion 66 is greater than the width W2 of the lower trough portion 64 to accommodate the plate 62.

The stepped trough portion 66 can receive the plate 62 such that an outer surface 68 of the plate 62 is flush with an outer surface 70 of the ceramic core portion 48 (See FIG. 5A). The plate 62 may be glued in place at the stepped trough portion 66, or may be press fit. The plate 62 includes one or more openings 72 for receiving a portion 74 of the RMC portion 50. The number, size and configuration of the openings 72 can vary. For example, the plate 62 could include a single, longitudinally disposed slot or a plurality of rectangular openings. The lower trough portion 64 may receive an adhesive 76 for attaching the refractory metal core portion 50 the ceramic core portion 48. Example adhesives 76 include, but are not limited to, glues, ceramic adhesives, ceramic matrixes, ceramic patch materials and aqueous colloidal silica content 20%-30%. The plate 62 covers the trough 56 and provides a consistent surface to assemble the hybrid core assembly 46 while maintaining the adhesive 76 below the plate 62.

As depicted by FIG. 5C, the trough 56 of the ceramic core portion 48 can include a uniform geometry. In other words, it is not necessary for the trough 56 to be stepped. The plate 62 is received directly against the outer surface 70 of the ceramic core portion 48 in the vicinity of the trough 56, in this example.

Referring again to FIG. 5B, the RMC portion 50 can include one or more finger portions 74 that are received in the opening(s) 72 of the plate 62. A first portion 78 of the finger portion(s) 74 is positioned on a trough side TS of the plate 62 (i.e., below the plate 62), while a second portion 80 of the finger portion(s) 74 extends in an opposite direction away from the plate 62 (i.e., above the plate 62). In this example, the finger portion(s) 74 extends transversely from a body portion 82 of the RMC portion 50, although other configurations are also contemplated.

To assemble the hybrid core assembly 46, a plate 62 is first positioned relative to each RMC portion 50 that must be attached to the ceramic core portion 48 (except for any trailing edge RMC portion, which does not necessarily require a plate 62). The plate(s) 62 is positioned relative to an RMC portion 50 by inserting the finger portion(s) 74 through the opening(s) 72 of the plate 62. The plate 62 is moveable relative to the RMC portion in the direction of arrow Y to facilitate placement of the plate 62. Next, the plate 62 is positioned relative to the trough 56 by moving the plate 62 in the direction Y and into the trough 56, such as within the stepped trough portion 66. Finally, if necessary, adhesive 76 can be added to the trough 56 to maintain the positioning of the RMC portion 50 relative to the ceramic core portion 48. However, as discussed below, the adhesive 76 is not necessary in all embodiments of this disclosure.

FIGS. 6-10 illustrate numerous alternative hybrid core assemblies 146, 246, 346, 446, 546 and 646. These example hybrid core assemblies can attach the RMC portions 50 to the ceramic core portions 48 without using adhesive.

Figure 6A:
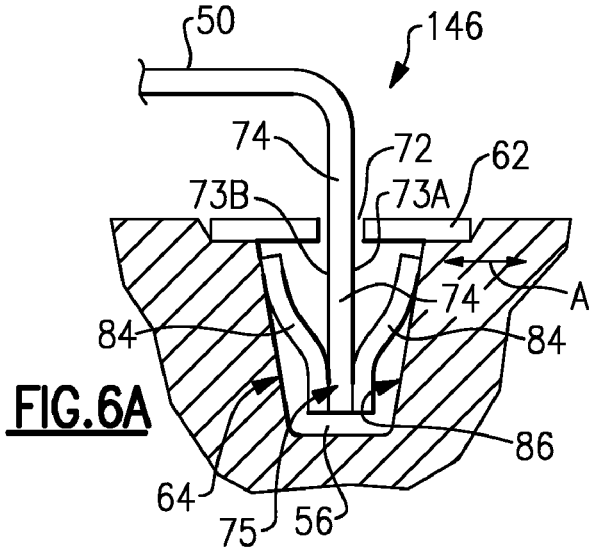
FIGS. 6A and 6B illustrate another exemplary hybrid core assembly.
Figure 6B:
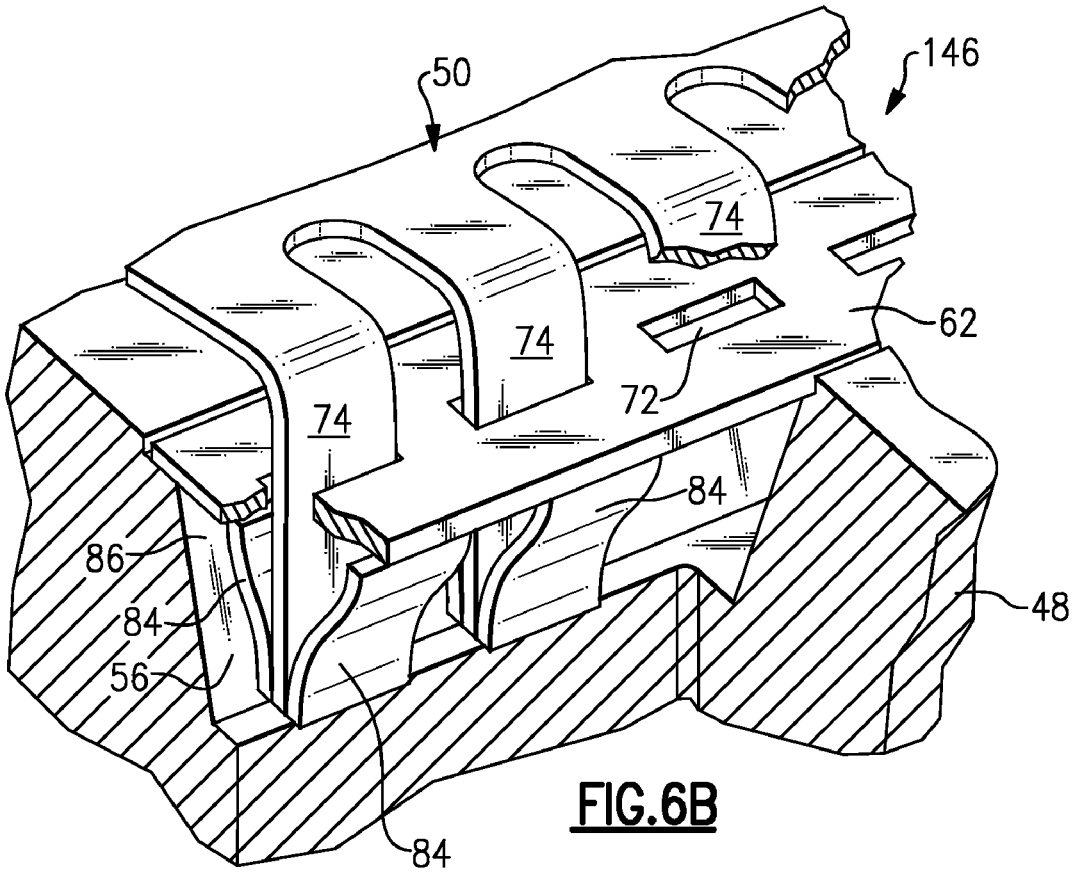

For example, as illustrated by FIGS. 6A and 6B, an example hybrid core assembly 146 includes spring plates 84 that are attached to opposing sides 73A, 73B of the finger portions 74 of the RMC portions 50. In one example, the spring plates 84 are friction welded to the finger portion(s) 74, although other attachment methods are contemplated. The spring plates 84 can be attached to the RMC portion 50 after the plate 62 is positioned relative to the RMC portion 50. The spring plates 84 can be attached to a distal end portion 75 of the finger portions 74 or at any other location.

The spring plates 84 are generally flexible in the direction of arrow A. Therefore, once the plate 62 is positioned relative to RMC portion 50 by extending the finger portion(s) 74 through the openings 72 of the plate 62 and the spring plates 84 are welded to the finger portion(s) 74, the spring plates 84 may be inserted into the trough 56. The spring plates 84 expand outwardly within the trough 56 and interact with a sidewall 86 of the lower trough portion 64 to maintain the refractory metal core portion 50 in place without using adhesive. The plate 62 is then moved to cover the trough 56, such as within the stepped trough portion 66.

Figure 7:
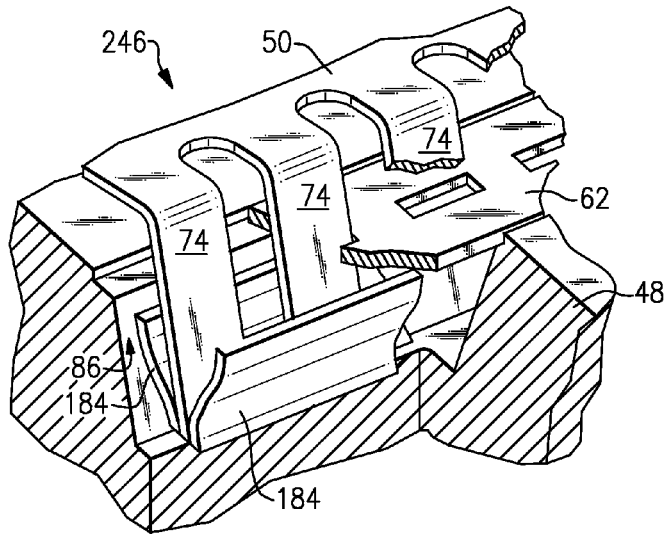
FIG. 7 illustrates another example hybrid core assembly.

FIG. 7 illustrates another example hybrid core assembly 246. In this example, the hybrid core assembly 246 includes spring plates 184 that are attached to more than one finger portion 74 ((2) finger portions 74 in this example) of the refractory metal core portion 50. In other words, the spring plates 184 can be sized such as to interact with multiple finger portions 74 and increase the surface area of interaction with the sidewall 86 of the trough.

Figure 8A:
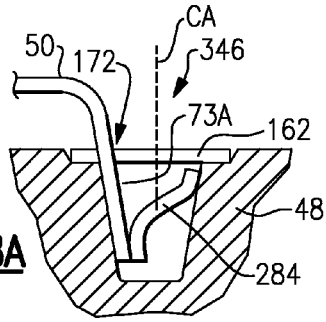
FIGS. 8A, 8B, 8C and 8D illustrate additional exemplary hybrid core assemblies.
Figure 8B:
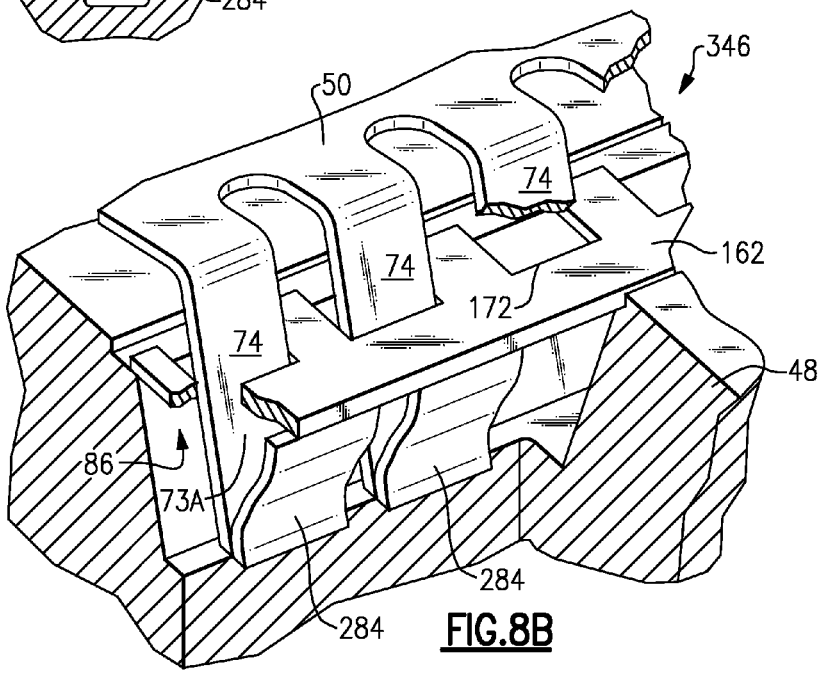

FIGS. 8A and 8B illustrate another example hybrid core assembly 346. In this example, the hybrid core assembly 346 includes a single spring plate 284 attached to only one side 73A of a finger portion 74. A plate 162 is positioned between the RMC portion 50 and the ceramic core portion 48. The plate 162 includes notched openings 172 that are offset from a centerline axis CA of the plate 162 to accommodate the "one-sided" spring plates 284.

Figure 8C:
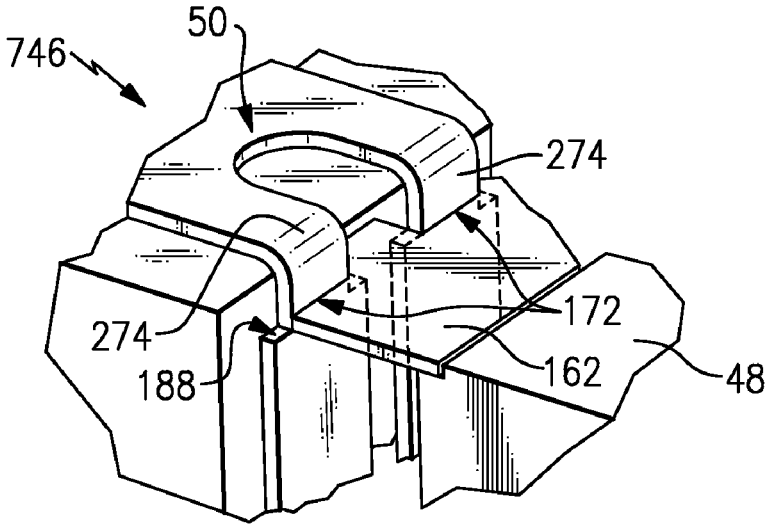
Figure 8D:
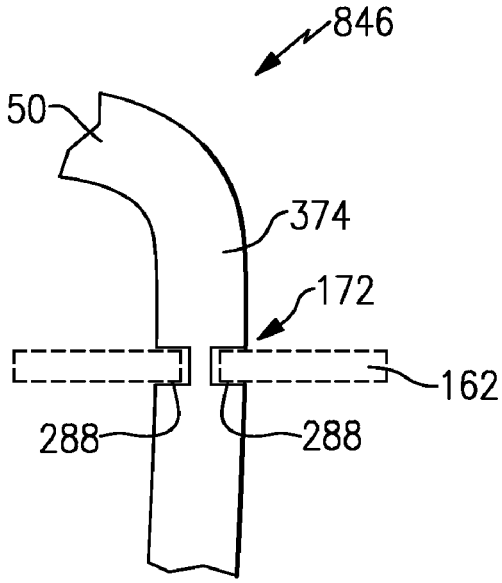

FIGS. 8C and 8D illustrate alternative hybrid core assemblies 746, 846 for accommodating the "one-sided" spring plates. The hybrid core assembly 746 of FIG. 8C includes a RMC portion 50 having fingers portions 274 that define support shoulders 188. A plate 162 having notched openings 172 is received on the support shoulders 188 to assemble the hybrid core assembly 746. In other words, in this example, a stepped trough is not required because the plate 162 is supported by the finger portions 274.

Alternatively, as shown in FIG. 8D, the hybrid core assembly 846 includes an RMC portion 50 having finger portions 374 that include slots 288. The slots 288 are received within the notched openings 172 of the plate 162 to assemble the hybrid core assembly 846.

Figure 9A:
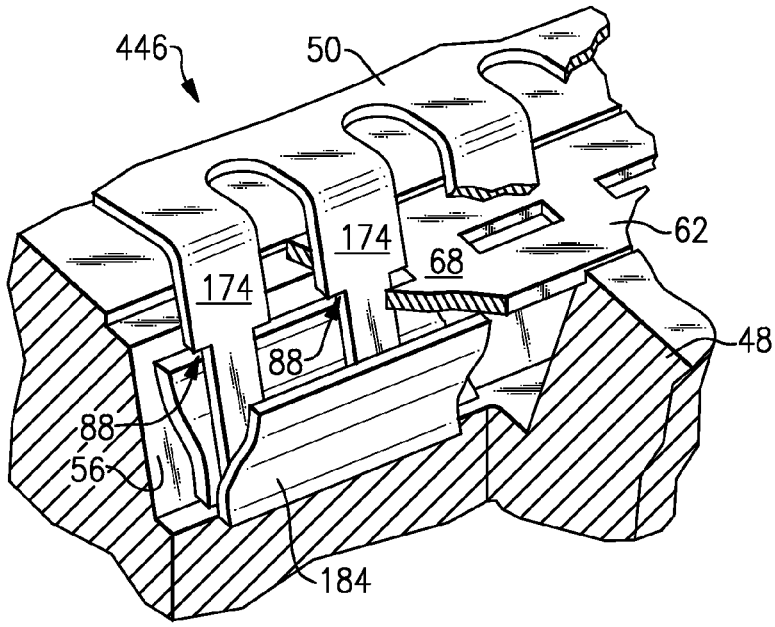
FIGS. 9A and 9B illustrate another example hybrid core assembly.
Figure 9B:
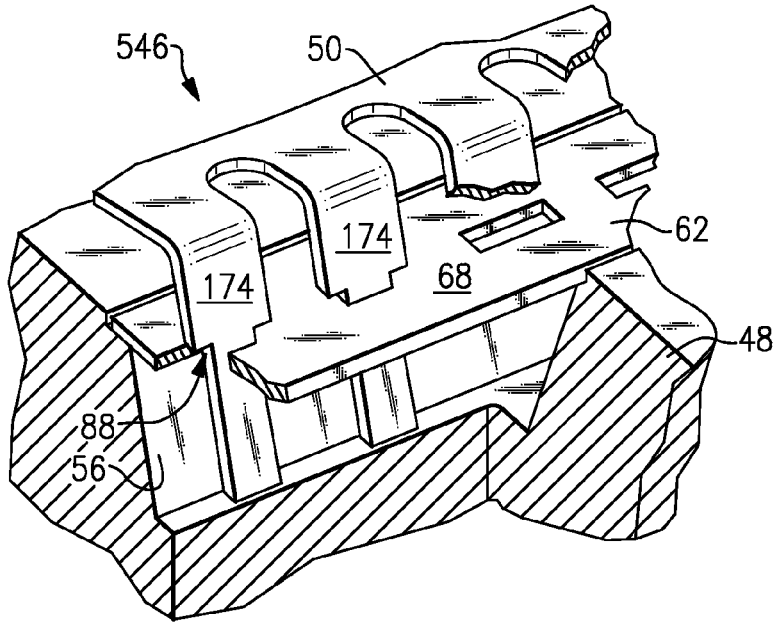

FIGS. 9A and 9B illustrate additional example hybrid core assemblies 446, 546 respectively. The hybrid core assemblies 446, 546 include a RMC portion 50 having finger portions 174 that define entrance shoulders 88. The entrance shoulders 88 dictate the distance that the finger portions 174 are inserted into the troughs 56. In other words, the entrance shoulders 88 abut an outer surface 68 of the plate 62 to limit the insertion depth of the RMC portion 50. In these examples, the hybrid core assembly 446 includes spring plates 184 while the hybrid core assembly 546 does not include any spring plates.

Figure 10:
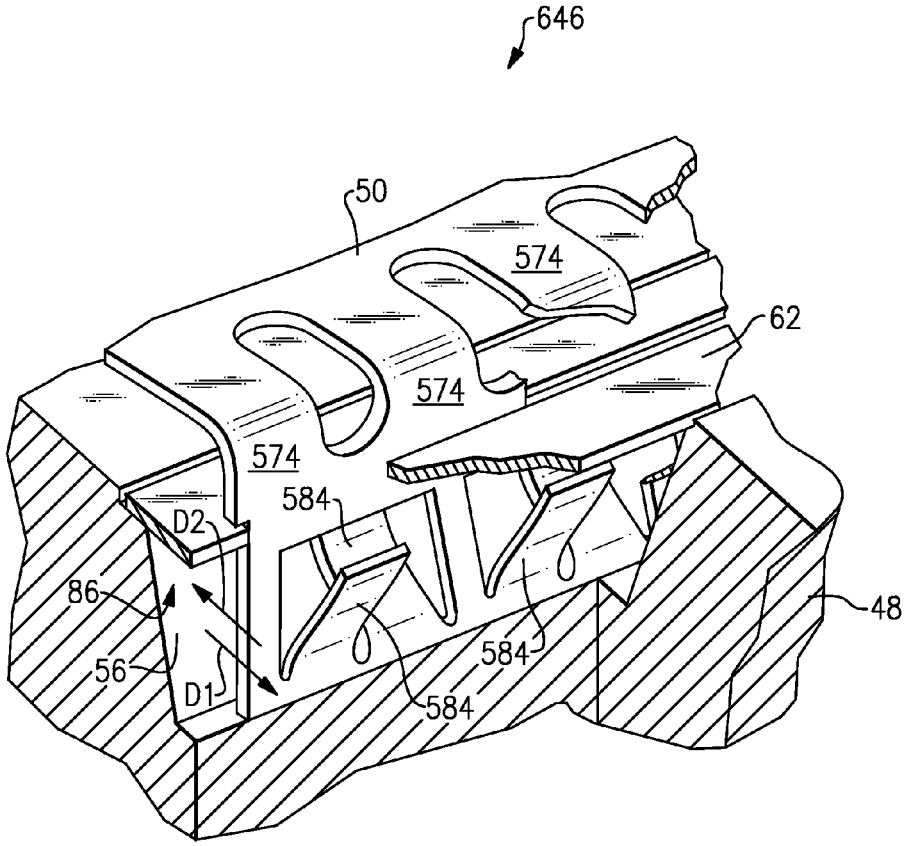
FIG. 10 illustrates yet another example hybrid core assembly.

FIG. 10 illustrates yet another example hybrid core assembly 646. In this example, the RMC portion 50 includes finger portions 574 having spring plates 584 that are cut-out from the finger portions 574 of the RMC portion 50. In one example, the spring plates 584 are cut-out in alternating directions D1 and D2 such that the spring plates 584 interact with opposite sidewalls 86 of the troughs 56.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A hybrid core assembly for a casting process, comprising:

a ceramic core portion having a first trough;

a first refractory metal core portion, wherein a portion of said first refractory metal core portion extends into said first trough; and a first plate positioned between said ceramic core portion and said first refractory metal core portion, wherein said first plate is moveable relative to said first refractory metal core portion to position said first plate relative to said ceramic core portion.

2. The assembly as recited in claim 1, comprising a second refractory metal core portion received in a second trough of said ceramic core portion and a second plate positioned between said ceramic core portion and said second refractory metal core portion.

3. The assembly as recited in claim 1, wherein said first trough includes a lower trough portion and a stepped trough portion, wherein said first plate is received within said stepped trough portion.

4. The assembly as recited in claim 3, wherein an outer surface of said first plate is flush with an outer surface of said ceramic core portion.

5. The assembly as recited in claim 1, wherein a finger portion of said first refractory metal core portion is received through an opening of said first plate.

6. The assembly as recited in claim 5, wherein said finger portion includes a shoulder that abuts an outer surface of said first plate to limit the depth of insertion of said first refractory metal core.

7. The assembly as recited in claim 1, comprising an adhesive received within said first trough.

8. The assembly as recited in claim 1, wherein a finger portion of said first refractory metal core portion includes spring plates that selectively expand to contact a sidewall of said first trough.

9. The assembly as recited in claim 1, wherein said first refractory metal core portion includes a plurality of finger portions having at least one spring plate.

10. The assembly as recited in claim 1, wherein said first refractory metal core portion includes a plurality of spring plates cut-out from said first refractory metal core portion.

11. The assembly as recited in claim 1, wherein said first plate includes a refractory metal.

12. The assembly as recited in claim 1, wherein said first plate includes a ceramic material.

13. The assembly as recited in claim 1, wherein said first plate includes a plurality of notched openings.

14. The assembly as recited in claim 13, wherein said plurality of notched openings are offset from a centerline axis of said first plate.

15. The assembly as recited in claim 14, wherein said first plate including said plurality of notched openings is received on support shoulders of said portion of said first refractory metal core portion.

16. A method of assembling a hybrid core assembly for a casting process, comprising the steps of:

(a) inserting a portion of a refractory metal core portion through an opening of a plate; and (b) positioning the plate relative to a trough of a ceramic core portion, wherein the plate is moveable relative to the refractory metal core portion during the step of positioning.

17. The method as recited in claim 16, wherein said step (b) occurs subsequent to said step (a).

18. The method as recited in claim 16, comprising the step of:

(c) filling the trough with an adhesive.

19. The method as recited in claim 16, comprising the step of:

(c) attaching spring plates onto the portion of the refractory metal core portion prior to said step (b).

20. The method as recited in claim 19, comprising the step of:

(d) pushing the spring plates into the trough such that the spring fingers contact a sidewall of the trough.

21. A hybrid core assembly for a casting process, comprising:

a ceramic core portion having a first trough;

a first refractory metal core portion, wherein a portion of said first refractory metal core portion extends into said first trough; and a first plate positioned between said ceramic core portion and said first refractory metal core portion; wherein said first plate is comprised of one of a refractory metal and a ceramic material.

22. A hybrid core assembly for a casting process, comprising:

a ceramic core portion having a first trough;

a first refractory metal core portion, wherein a portion of said first refractory metal core portion extends into said first trough; and a first plate positioned between said ceramic core portion and said first refractory metal core portion, wherein an outer surface of said first plate is flush with an outer surface of said ceramic core portion.

23. A method of assembling a hybrid core assembly for a casting process, comprising the steps of:

(a) inserting a portion of a refractory metal core portion through an opening of a plate;

(b) positioning the plate relative to a trough of a ceramic core portion; and (c) outwardly expanding spring plates that are attached to the portion of the refractory metal core portion such that the spring plates contact a sidewall of the trough.

* * * * *